US008363075B2

(12) United States Patent
Mason et al.

(10) Patent No.: US 8,363,075 B2
(45) Date of Patent: Jan. 29, 2013

(54) THERMAL TRANSFER PRINTHEAD AND PRINTING SYSTEM USING SUCH A PRINTHEAD

(75) Inventors: James L. Mason, York, PA (US); John R. Cheetham, York, PA (US)

(73) Assignees: John Marozzi, Boonton Township, NJ (US); Theresa Pugh, Parsippany, NJ (US); Barbara Batesko, Montville, NJ (US)

( * ) Notice: Subject to any disclaimer, the term of this patent is extended or adjusted under 35 U.S.C. 154(b) by 410 days.

(21) Appl. No.: 12/662,325

(22) Filed: Apr. 12, 2010

(65) Prior Publication Data

US 2011/0249070 A1 Oct. 13, 2011

(51) Int. Cl.
*B41J 2/00* (2006.01)

(52) U.S. Cl. ..... 347/188

(58) Field of Classification Search ..... 347/188, 347/189, 191, 194, 171; 400/76, 120.01
See application file for complete search history.

(56) References Cited

U.S. PATENT DOCUMENTS

| | | | | |
|---|---|---|---|---|
| 5,513,235 | A | 4/1996 | Douglass et al. | 377/25 |
| 2005/0185023 | A1 | 8/2005 | Furukawa et al. | 347/61 |
| 2005/0285924 | A1 | 12/2005 | Yang | 347/171 |

FOREIGN PATENT DOCUMENTS

| | | |
|---|---|---|
| EP | 541064 | 5/1993 |
| WO | 2009145774 | 12/2009 |

OTHER PUBLICATIONS

Dallas Semiconductor DS18B20-PAR 1-Wire Parasite-Power Digital Thermometer; 2003.

*Primary Examiner* — Kristal Feggins
(74) *Attorney, Agent, or Firm* — Jacobson Holman PLLC

(57) ABSTRACT

A printhead and print system is provided that includes a printer and a control unit connected by a cable. The printhead has a printed circuit board that is modified to include a digital thermometer having a non-volatile memory programmed with the printhead resistance. The control unit reads the printhead resistance directly from the printhead which improves print quality and eliminates the need for manual entry of the printhead resistance when the printhead is replaced. The modified printhead also uses fewer wires in the cable, allowing the cable to be made thinner and more manageable, and increasing the accuracy of temperature measurements conveyed thereover.

12 Claims, 6 Drawing Sheets

THERMAL TRANSFER PRINTHEAD AND PRINTING SYSTEM USING SUCH A PRINTHEAD

BACKGROUND OF THE INVENTION

1. Field of the Invention

The present invention is related to the field of thermal transfer printing and, more particularly, to an improved thermal transfer printhead and a printing system using such a printhead.

2. Description of the Related Art

Thermal transfer printers operate through selective heating of a plurality of microscopic heater elements within the printhead that, when activated, produce points of heat that correspond to each of the dots in an image line that is to be printed on a medium. The heated heater elements, when thereafter brought into contact with the ink on an adjacent ribbon, heat and transfer the ink onto the medium in points or dots corresponding with the dots in the desired image line.

To achieve optimal print quality, the printhead must operate at the correct energy level. Energy level is controlled by modulating both the voltage level applied to the printhead and the length of time that such voltage is applied. In order for the printer to correctly modulate these conditions, it is necessary for the printer to be provided with the average resistance value of the printhead's heater elements and the overall temperature of the printhead. Since, as manufactured, each printhead's heater elements may have a slightly different characteristic resistance value, the manufacturer provides the specific resistance value with each printhead. When the printhead is replaced by the customer, the resistance of the new printhead must be manually entered into the printer control box. Many times, customers do not update the printer resistance value, however, resulting in poor print quality and placing stress on the printing system. In addition, when obtaining new printheads, customers may purchase aftermarket printheads that are inferior to the original printhead obtained with their system. This can also cause poor print quality and, if the replacement printhead is untested or unapproved by the original equipment manufacturer, typically voids any warranty on the printing system due to the negative impact of such printheads on print operation and system performance.

Printhead temperature is monitored on an on-going basis using a sensor located on the printhead printed circuit board (PCB). The temperature reading is transmitted to a printer control box that is separate from the printhead and connected thereto by a cable.

Problems have arisen in that the cable between the control box and the printhead is made up of many wires and therefore is typically thick, expensive and hard to work with. Since all of the wires in the cable have particular purposes, adding new features to the printhead which are to be supported by communication over the cable requires that additional wires be added, making the cable even more cumbersome.

Furthermore, the cable between the printhead and the control box is often of considerable length which, due to electrical noise or other interference, can negatively impact the accuracy and/or update consistency of the temperature measurement that is sent from the printhead to the control box. The conventional temperature sensor used in the printhead PCB produces a small voltage difference between degree increments. This voltage can be more easily affected by electrical noise, etc., when the cable length between the printhead and the control box is lengthy. When the voltage is adversely affected by long cable length, the customer may note that changes in the temperature reading increment by more than one degree between readings. Changes in the temperature reading by more than one degree at a time can give the user the impression that the temperature reading is not very accurate or up to date, reducing customer confidence in the printhead quality even though the difficulty lies in the cable length and not in the printhead itself.

Accordingly, a need exists for an improved thermal transfer printhead that overcomes the foregoing problems in the prior art.

SUMMARY OF THE INVENTION

In view of the foregoing, one object of the present invention is to overcome the difficulties of updating printhead resistance when a printhead is replaced.

Another object of the present invention is to provide a thermal transfer printhead in which the resistance is automatically updated by the control box without the need for manual customer entry.

A further object of the present invention is to provide a thermal transfer printhead which has been modified to be particularly suited to a specific printing system, namely a printing system sold by Bell-Mark Sales Company ("Bell-Mark"), such that aftermarket printhead replacement alternatives cannot be used in a Bell-Mark printing system.

Yet another object of the present invention is to provide a thermal transfer printhead in accordance with the preceding objects that consistently provides high print quality due to the characteristics of the Bell-Mark printer and its use with a quality printhead specifically made for use in such printer.

A still further object of the present invention is to provide an improved printing system having a thermal transfer printhead in accordance with the preceding objects in which the cable between the printhead and the control box can be made thinner and therefore is easier to work with.

Another object of the present invention is to provide an improved printing system in accordance with the preceding objects in which the cable between the printhead and the control is able to support additional features without increasing the size of the cable.

Yet another object of the present invention is to provide a thermal transfer printhead in accordance with the preceding objects having a modified printhead PCB with a digital thermometer rather than a thermistor for increased accuracy in temperature measurement.

Yet a further object of the present invention to provide a printing system with an improved printhead and printhead cable that is not complex in structure and which can be manufactured at low cost but yet efficiently maintains high print quality.

In accordance with these and other objects, the present invention is directed to a printhead in which the PCB thereof has been modified to replace the thermistor of the original PCB with a digital thermometer. The digital thermometer has an EEPROM that is programmed with the printhead resistance and automatically readable by the printer control box so that manual entry of the resistance into the printer control box is not necessary. In addition, replacement of the original thermistor with the digital thermometer frees up two wires in the cable used to connect the printhead to the control box. These two wires can either be removed, making the cable thinner and easier to manage, or used to add new features to the print system.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
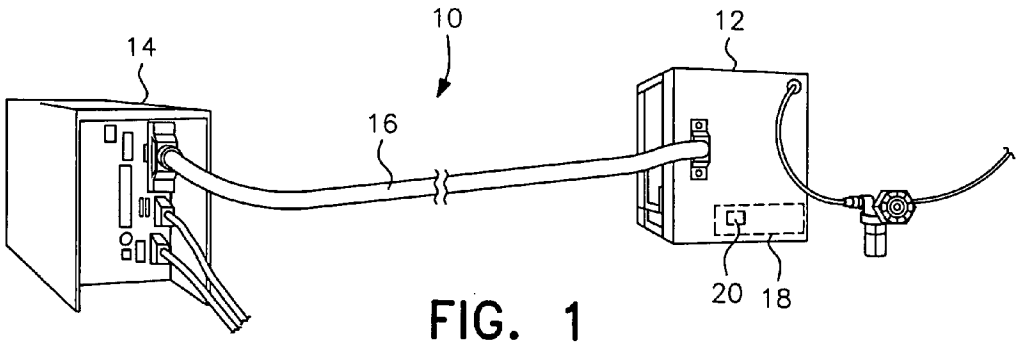
FIG. 1 is a drawing of the components of a printing system with control box, printer and improved printhead in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
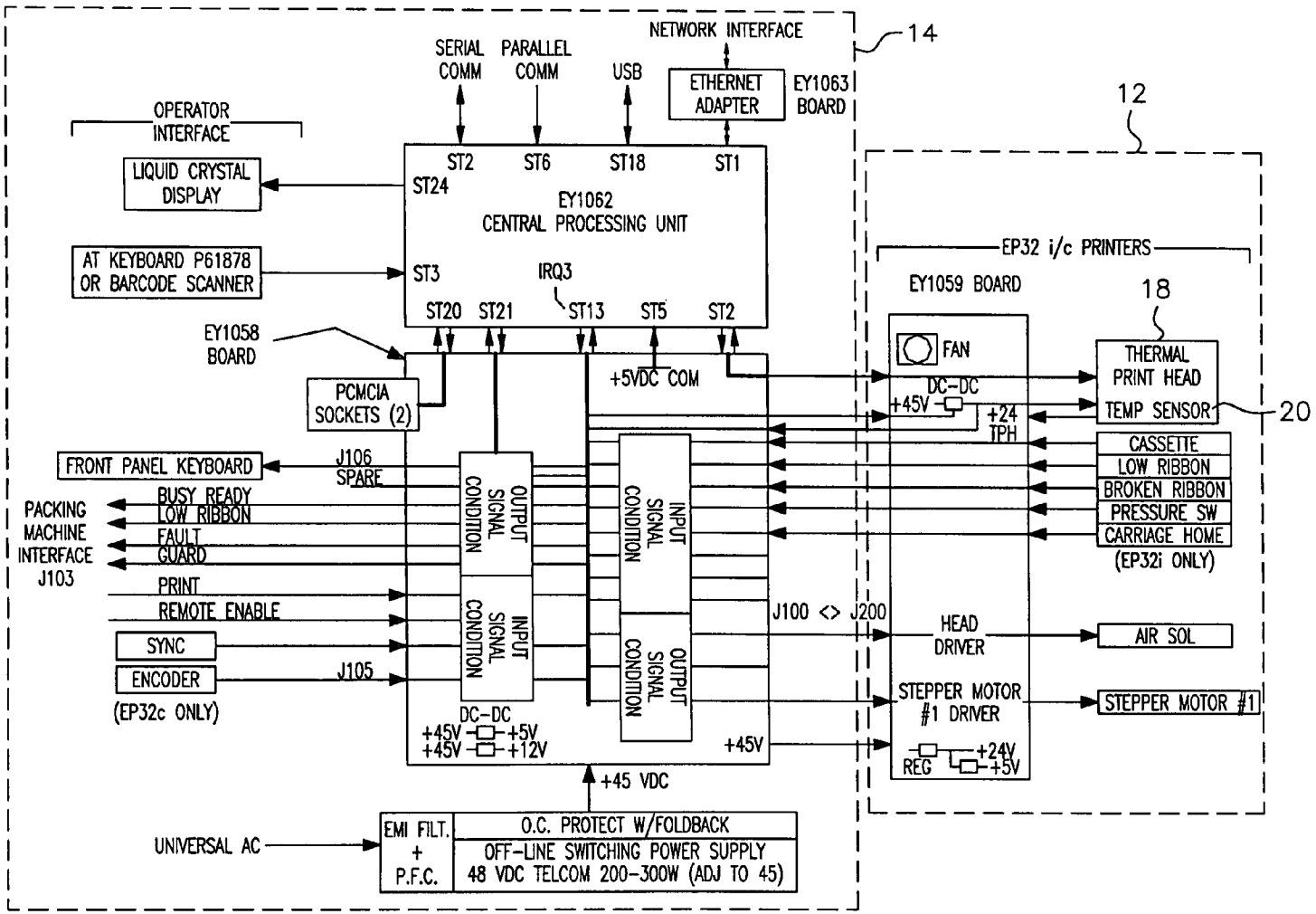
FIG. 2 is an electrical block diagram showing the components of the control box and printer shown in FIG. 1.

As shown in FIG. 1, the present invention is directed to a print system generally designated by reference numeral 10. The print system includes a printer 12, a control box 14 and a cable 16 connecting the printer 12 to the control box 14. As representatively shown by the dotted-line blocks in FIG. 1, the printer 12 includes an improved printhead 18 having a modified printed circuit board 20 that includes a digital thermometer 42 (see FIG. 7) integrated therewith as will be discussed further hereinafter. An electrical block diagram of these components is set forth in FIG. 2.

Figure 5:
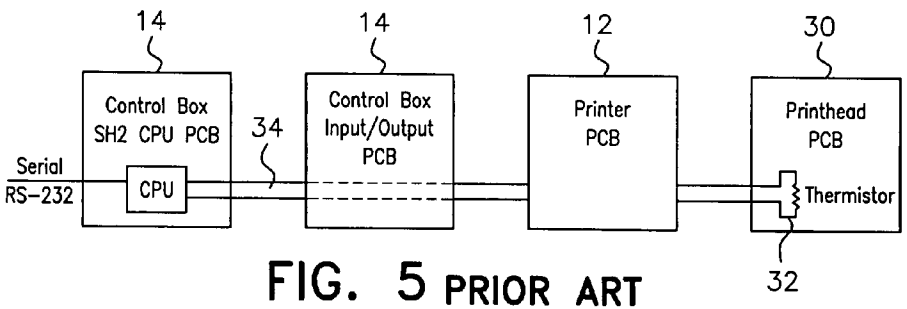
FIG. 5 PRIOR ART
FIG. 5 is a block diagram of the printhead shown in FIGS. 3 and 4 having a thermistor as part of a printer and coupled to the control box.
Figure 3:
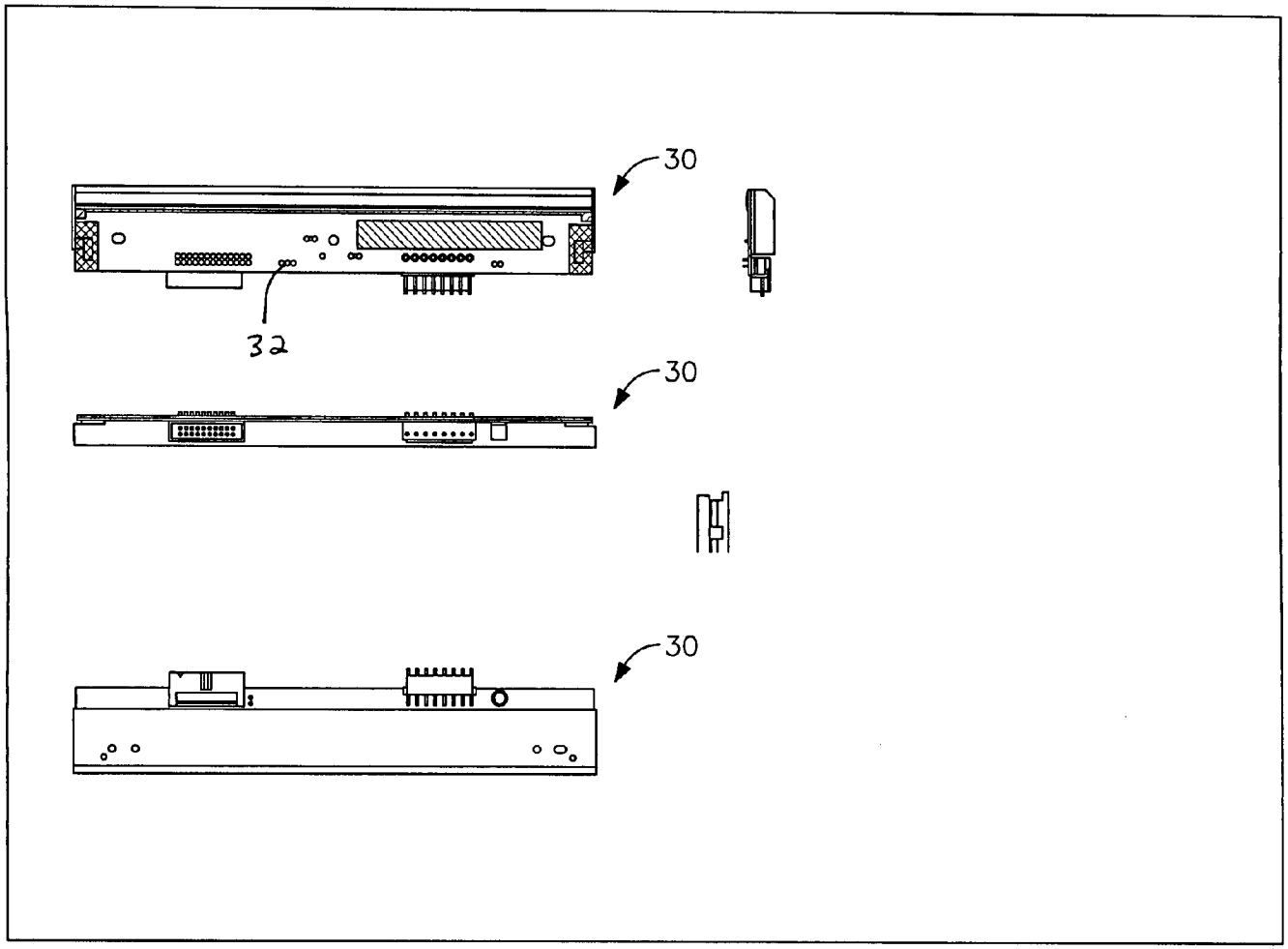
FIG. 3 PRIOR ART
FIG. 3 is a diagram of the components of a conventional printhead before modification.
Figure 4:
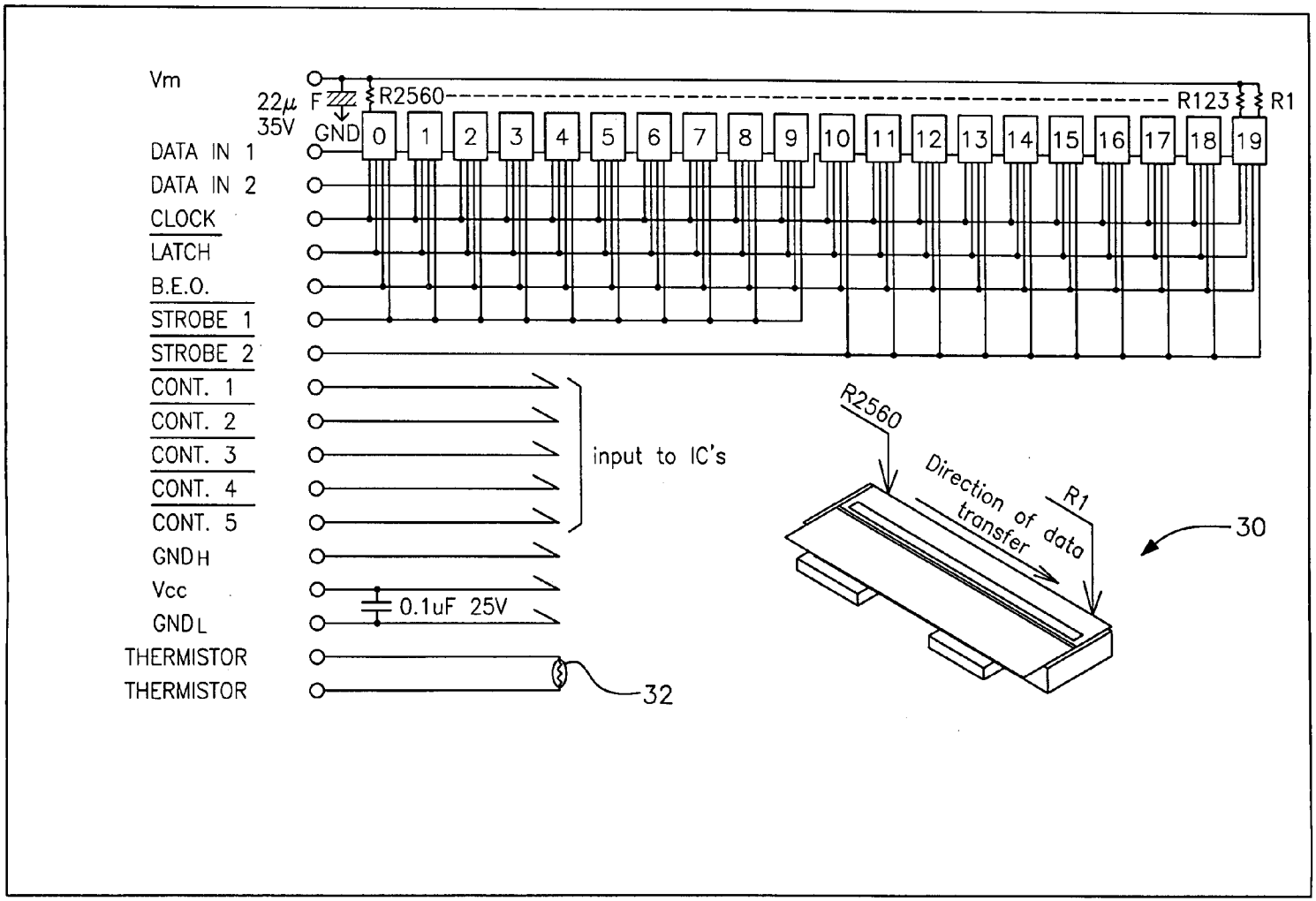
FIG. 4 PRIOR ART
FIG. 4 is a block diagram of the conventional, unmodified printhead shown in FIG. 3.

Various views of a conventional printhead, in this case a printhead manufactured by KYOCERA generally designated by reference numeral 30, is shown in FIG. 3 as well as in the block diagram of FIG. 4. According to this conventional design, the printhead includes a thermistor 32 that provides temperature information to the control box 14. This temperature information is used to ensure optimal print quality from the printer 12 as is known to persons of ordinary skill in the art. The thermistor 32 requires the use of two wires within the cable 34 for communication with the control unit. In addition, the cable 34 has a number of other wires for specific purposes, resulting in the cable being thick and difficult to work with. A block diagram of the control box and printhead as conventionally connected by a thick cable 34 is shown in FIG. 5.

The conventional printhead 30 also requires that the customer or user manually enter the characteristic average resistance value of the heater elements of the particular printhead into the printer control box when the printhead is replaced. Failure to do so has traditionally resulted in poor print quality and undesirable stressing of the printhead.

The present invention addresses both the problems of cable thickness and entry of printhead resistance by modifying the conventional printhead as set forth herein.

Figure 6:
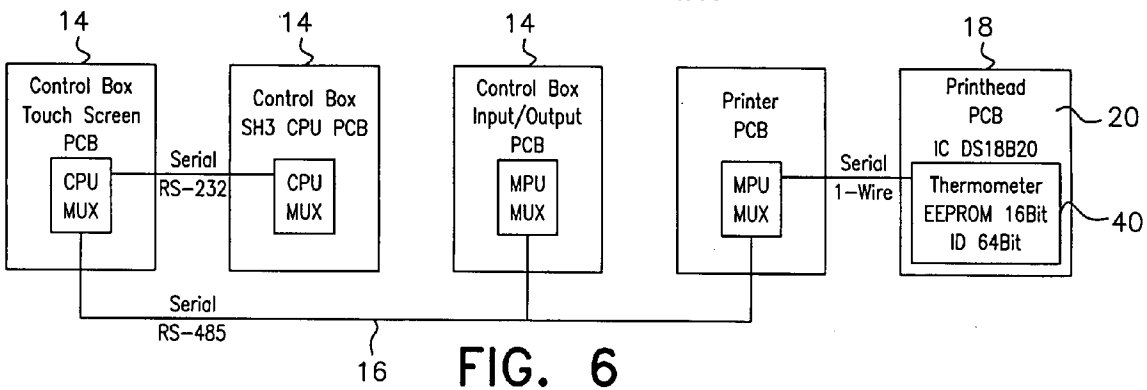
FIG. 6 is a block diagram of the improved printhead following modification in accordance with the present invention and shown with the printer and control box.

More particularly, as shown in FIG. 6, according to the present invention the PCB 20 of the printhead 18 is modified to include a non-volatile memory 40 that is programmed with the resistance value of the printhead. Such programming is preferably accomplished by programming the memory on the PCB with a number that represents the characteristic average resistance value of the printhead's heater elements. By programming the resistance value into the PCB, the user does not have to manually enter the resistance. Rather, the control unit 14 can efficiently determine the resistance directly from the programmed PCB memory on the printhead 18, over the cable 16, when the printhead is replaced.

The non-volatile memory is preferably an electrically erasable programmable read-only memory (EEPROM), although other forms of non-volatile memory could also be used as would be understood by persons of ordinary skill in the art. Preferably the EEPROM has two bytes of memory to store a high precision printhead resistance and to provide a more secure encryption, although EEPROMs having only one byte could be used if a lower precision printhead resistance is considered adequate. EEPROMs having greater memory capacity could also be used.

Figure 7:
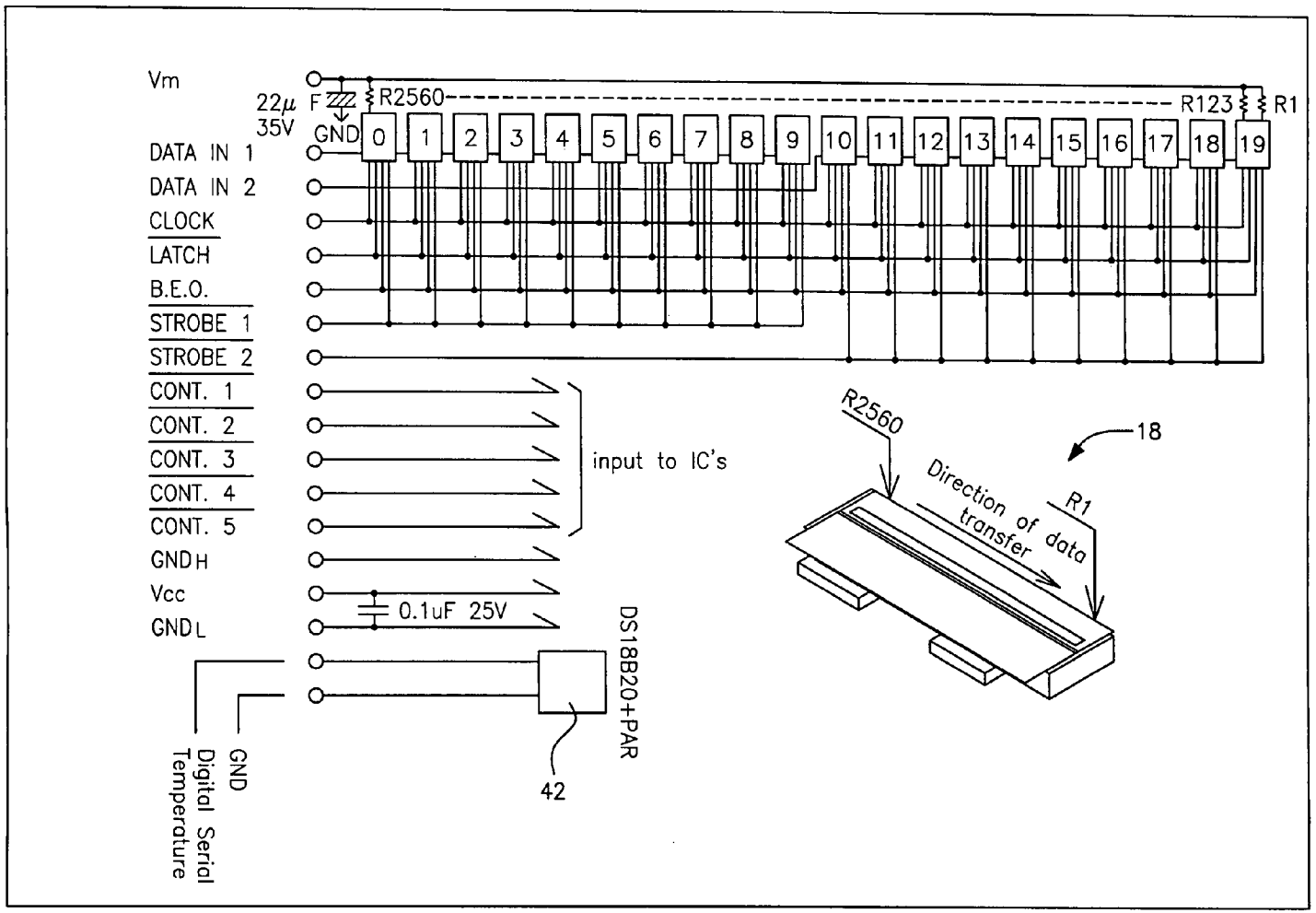
FIG. 7 is a block diagram of the improved printhead shown in FIG. 6.

According to a preferred embodiment shown in FIG. 7, the non-volatile memory is part of a digital thermometer 42 integrated into the PCB. One preferred embodiment of the digital thermometer 42 is a DS18B20+PAR digital thermometer manufactured by Maxim Integrated Products, Inc. ("Maxim Integrated Products") of Sunnyvale, Calif. Other digital thermometers could also be used.

The DS18B20+PAR digital thermometer as obtained from Maxim Integrated Products includes a feature by which alarm conditions can be reported. Specifically, this thermometer uses two bytes of EEPROM to store "Too High" and "Too Low" temperature threshold values. When the thermometer is reconfigured according to the present invention, it is these two bytes that are used to hold the printhead resistance value in a securely encoded format.

With respect to encoding, the DS18B20+PAR digital thermometer as procured includes an algorithm for programming or reading the part that is documented by Maxim Integrated Products. In addition, when programming the EEPROM with the printhead resistance according to the present invention, a cipher is used to encode and decode the resistance value that will be stored to and read from the EEPROM. The cipher serves to ensure that the EEPROM data has been correctly programmed and has not been corrupted, and is also used as a protective measure against copying by competitors or other individuals in the marketplace. Techniques for programming with a cipher would be understood by persons of ordinary skill in the art.

Figure 8:
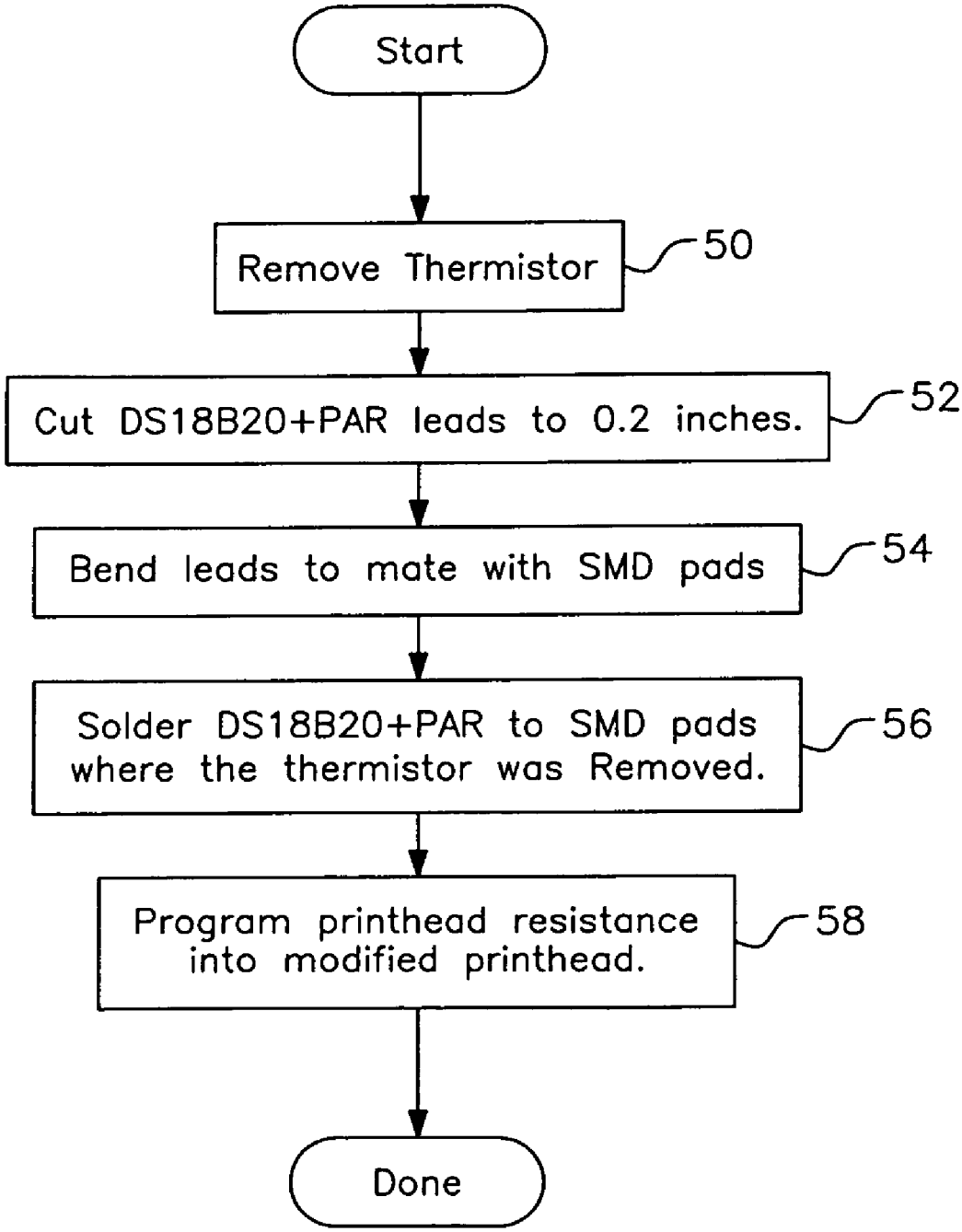
FIG. 8 is a flowchart of the steps taken to modify the printhead of FIGS. 3 and 4 to produce the printhead of FIG. 7 in accordance with the present invention.

According to the present invention, modification of the printhead 18 to include the DS18B20+PAR digital thermometer 42 is performed by removing the pre-existing thermistor 32 and replacing the same with the thermometer 42. This process is summarized in the flowchart of FIG. 8 and begins by removing the thermistor, step 50. The leads on the DS18B20+PAR digital thermometer are then preferably cut to a length of about 0.2 inches, step 52, although any lead length could be used provided a good quality electrical connection is obtained between the thermometer and the PCB. The leads are bent or otherwise made to mate with the surface mounted device (SMD) pads, step 54, and are then soldered to the SMD pads in the place where the thermistor was removed, step 56. The EEPROM in the thermometer is then programmed with the printhead resistance, step 58.

While the foregoing steps effectively integrate the existing DS18B20+PAR digital thermometer with the PCB, it would be understood by persons of skill that if an alternately designed digital thermometer, having features like the DS18B20+PAR thermometer but packaged as a surface mounted device like the thermistor, the above steps relating to the leads would not be necessary.

When the printhead PCB 20 is modified in the foregoing manner, the DS18B20+PAR digital thermometer 42 takes the place of the originally installed thermistor 32. Because the thermistor used an analog signal that required two dedicated wires, replacing the thermistor with the digital thermometer eliminates the need for these two wires, freeing them up to be used for new features to be added or simply eliminated to make the cable 16 thinner. The temperature measurement from the new thermometer, being a digital signal, can be multiplexed with other digital signals for transmission on one of the other already existing cable wires, as would be understood by persons of ordinary skill in the art. Temperature measurements and resistance values from more than one printhead can also be sent over the same wire, enabling the present invention to readily support a printer having twin printheads such as that developed by Bell-Mark Corporation of Pine Brook, N.J. Multiplexing of multiple digital signals for transmission and demultiplexing thereof at the receiving end is known in the art. In the embodiment shown in FIG. 6, a RS-485 bus is used to pass the temperature measurements to the control box but other data communication techniques could also be used to transfer the digital data as persons of skill would understand.

In addition to reducing cable thickness, use of a digital thermometer in place of the thermistor results in improved results as measurements taken by the digital thermometer are accurate to +/−0.5 degrees C. This is about four times more accurate than the conventional thermistor design. This improved accuracy, as well as the thinner cable design, ensures customers of a high quality product that will perform with robust consistency and greater ease in management of the physical components. In addition, because a value representing the printhead resistance is programmed into each individual printhead and read directly by the control unit 14, when replacement of the printhead is necessary, customers having Bell-Mark thermal printers must use the modified printheads with digital thermometer as described herein. This prevents the customer from using inferior aftermarket printhead products that, while perhaps being less expensive in purchase price, actually harm the customer in that such aftermarket products both reduce print quality and shorten the life of the thermal printer through continued operation of the printer at inappropriate settings over time.

The present invention further includes an embodiment in which the control box and the printer are integrated with one another such that a cable connecting them is not necessary. All of the foregoing description relating to the modification of a digital thermometer to store printhead resistance is equally applicable to such an integrated embodiment and therefore the details thereof are considered to have already been fully set forth herein and will not be repeated.

The foregoing description and drawings should be considered as illustrative only of the principles of the invention. The invention may be configured in a variety of ways and is not limited by the dimensions of the preferred embodiment. Therefore, it is not desired to limit the invention to the specific examples disclosed or the exact construction and operation shown and described. Rather, all suitable modifications and equivalents may be resorted to, falling within the scope of the invention.

What is claimed is:

1. A thermal transfer printhead comprising:

printing components for transferring ink to a printing medium;

a printed circuit board (PCB) in communication with the printing components; and a digital thermometer integrated into the PCB, said digital thermometer including as a part thereof a non-volatile memory programmed with a resistance value of said printhead.

2. The thermal transfer printhead as set forth in claim 1, wherein said non-volatile memory is an EEPROM having at least one byte of memory that is programmed with said resistance using an algorithm.

3. The thermal transfer printhead as set forth in claim 1, wherein said resistence is encoded using a cipher.

4. The thermal transfer printhead as set forth in claim 1, wherein the thermometer is a DS18B2O+PAR digital thermometer.

5. The thermal transfer printhead as set forth in claim 1, wherein:

said printhead is connected by a cable to a control unit remote from said printhead, for transmission of said resistance value to said control unit over said cable when the printhead is replaced.

6. The thermal transfer printhead as set forth in claim 5, wherein said resistance value is transmitted as a digital signal for multiplexing with other digital signals transmitted from the printhead to the control unit over the cable.

7. A print system comprising:

a printhead with a PCB;

a digital thermometer integrated into the PCB, said PCB digital thermometer including as a part thereof a non-volatile memory programmed with a resistance of said printhead; and a control box in communication with the printhead, said control box reading said resistance directly from the printhead.

8. The print system as set forth in claim 7, wherein said non-volatile memory is an EEPROM.

9. The print system as set forth in claim 7, further comprising a cable connecting said control box to said printhead for transmitting said resistance value from said printhead to said control box when the printhead is replaced.

10. The print system as set forth in claim 9, wherein said resistance value is transmitted as a digital signal for multiplexing with other digital signals transmitted from the printhead to the control unit by the cable.

11. The print system as set forth in claim 7, wherein said non-volatile memory is an EEPROM.

12. The print system as set forth in claim 11, wherein said resistance programmed in said EEPROM is encoded using a cipher.

* * * * *